United States Patent [19]

Salemink

[11] 4,316,336

[45] Feb. 23, 1982

[54] DRIVE MECHANISM FOR SAND, ETC., DREDGING APPARATUS

[75] Inventor: Willard L. Salemink, West Liberty, Iowa

[73] Assignee: Assemblers, Inc., West Liberty, Iowa

[21] Appl. No.: 154,699

[22] Filed: May 30, 1980

[51] Int. Cl.[3] ..... E02F 3/88

[52] U.S. Cl. ..... 37/67; 277/3

[58] Field of Search ..... 37/67, 64–66, 37/58, 56; 277/3; 175/107

[56] References Cited

U.S. PATENT DOCUMENTS

| | | | |
|---|---|---|---|
| 484,763 | 10/1892 | Bowers | 37/67 |
| 1,861,349 | 5/1932 | Lockett | 37/67 |
| 2,908,534 | 10/1959 | Rietsch | 175/107 X |
| 2,990,894 | 7/1961 | Mitchell et al. | 175/107 |
| 3,088,744 | 5/1963 | Ezekiel et al. | 277/3 |
| 3,631,834 | 1/1972 | Gardner et al. | 277/3 X |

FOREIGN PATENT DOCUMENTS

| | | | |
|---|---|---|---|
| 7611570 | 4/1978 | Netherlands | 37/67 |
| 10114 | of 1910 | United Kingdom | 37/67 |

*Primary Examiner*—Clifford D. Crowder

*Attorney, Agent, or Firm*—Henderson & Sturm

[57] ABSTRACT

A dredging apparatus for extracting sand, gravel and the like from the bed of a body of water features an improved drive mechanism having an enclosed drive shaft between an above-water carrier to an under-water excavator or the like, the enclosed drive being substantially water-tight and pressurized to at least partly balance the interior of the enclosure means and the bearing and seal contained therein against the under-water pressure exerted externally of the enclosure. More specifically, the enclosure is supplied with fluid from a power source that includes a hydraulic drive means.

4 Claims, 5 Drawing Figures

DRIVE MECHANISM FOR SAND, ETC., DREDGING APPARATUS

BRIEF SUMMARY OF THE INVENTION

A typical dredging apparatus for extracting sand, gravel and the like from the bed or bottom of a body of water, such as a lake, pond, etc., includes an above-water carrier, normally floating: e.g., a boat, barge, etc.; although, the carrier could be an onshore site such as a dock, etc. The dredging device usually includes one form or another of excavator or cutterhead operable under water to dig, agitate, etc., the sand or gravel for facilitating its on-carrier delivery via a suction tube or the like. The excavator will have a driven part powered by a carrier-based power source from which a drive shaft extends to the driven part, and this will include bearing and seal means intended to protect the bearing against premature wear from the contaminants entrained in the water; e.g., fines and other particles that find their way past the seal and into the bearing because of the under-water pressure exerted against the under-water sides of the seal and bearings. Heretofore, protection of the bearing has been achieved at the expense of complicated and high-cost seals, typical of which is the so-called marine seal.

According to the present invention, the foregoing and other problems are eliminated or at least minimized by a novel construction in which the shaft, bearing and seal are enclosed by a water-tight casing means, and especially such casing means that is interiorly supplied with fluid to at least partially balance the under-water pressure acting against the seal from without the casing means. It is a further feature of the invention that the casing means fluid is supplied from a hydraulic drive means that powers the shaft that drives the excavator part. A still further feature is the provision of means venting the interior of the casing means to atmosphere for the purpose of carrying a head of balancing fluid as the water pressure increases in response to descent of the excavator to lower depths. It is significant that the casing means forms part of the basic support that mounts the excavator on the carrier, thus minimizing expense, complicated design and costly maintenance. It is a further object of the invention to so construct the support, casing, etc., as to enable the use of relatively simple, inexpensive bearing and seal means. Further features will appear as the disclosure progresses.

DETAILED DESCRIPTION

Figures 1, 2, 3, 4, 5:
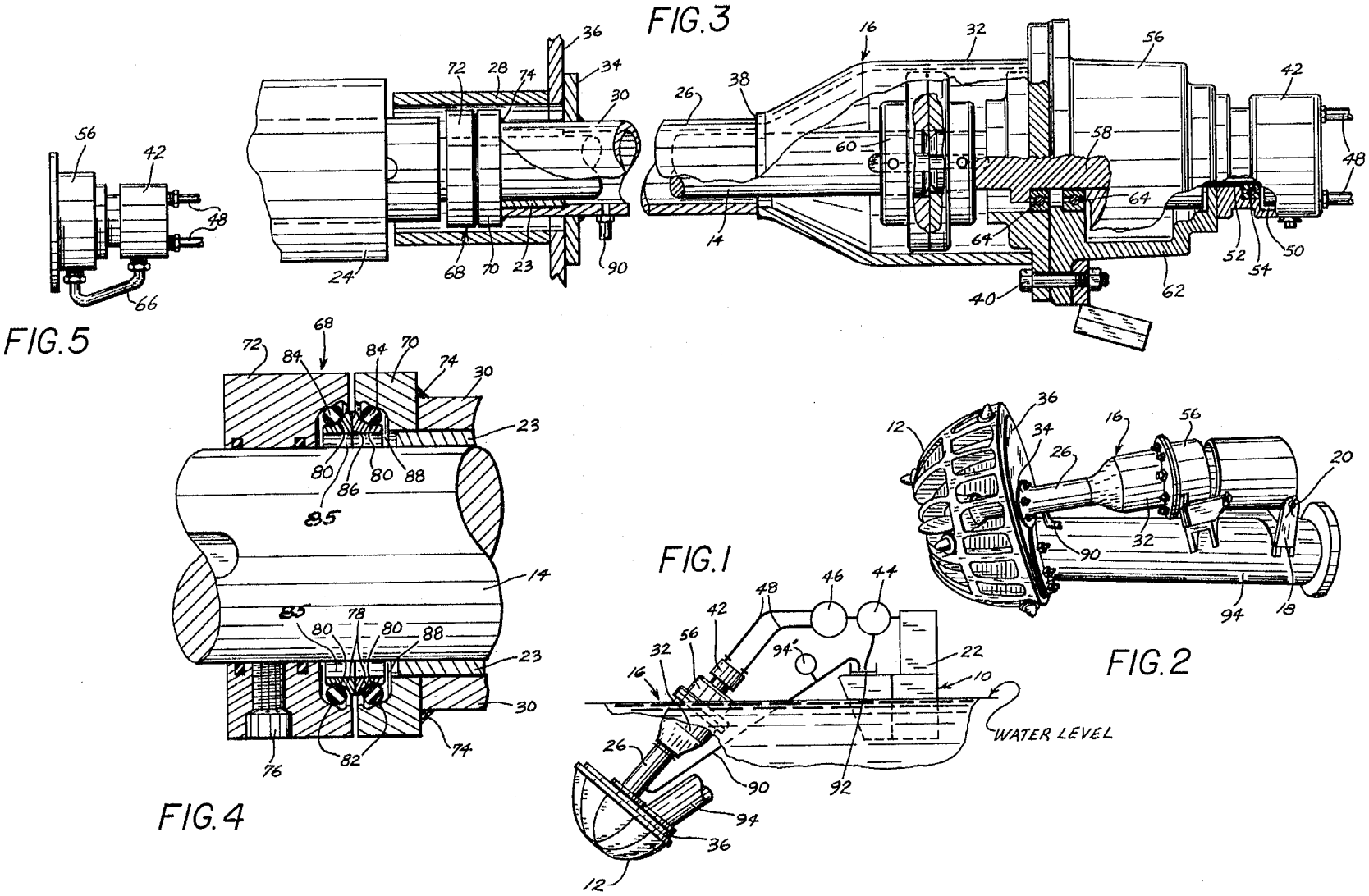
FIG. 1 is a somewhat schematic view illustrating the basic dredging apparatus and power source therefor.
FIG. 2 is a perspective of the support arm and excavator.
FIG. 3 is an enlarged longitudinal section, with portions broken away, showing the support, drive shaft and casing means.
FIG. 4 is a still further enlarged view showing, partly in section, that area of the drive in which the seal means is installed.
FIG. 5 is a smaller view illustrating an alternative arrangement of conducting hydraulic fluid from the hydraulic motor to the adjacent torque hub or amplifier.

Reference will be had first to FIG. 1 for a general description of the present design to the extent that it is typical in most respects of a dredging apparatus of known arrangement. The numeral 10 designates a base or carrier, here a floating structure such as a boat, barge, etc., carried on a body of water, the level of which is appropriately labeled. The base could as well be a fixed onshore structure or equivalent site suitable for the purpose of mounting and carrying the excavator means, here shown as of the type including a cage cutterhead, or basket 12 or equivalent driven part keyed or otherwise fixed to a shaft 14 (FIGS. 3 and 4). This shaft is carried by a support 16, normally operative in the sloped position as seen in FIG. 1 but shown horizontally in FIGS. 3 and 4. The support is carried at its rear or boat end by any suitable means located in the area of a bracket 18 mounted on the boat and including provision for swinging of the support and basket in a vertical plane. A cross pivot is shown at 20 as a suitable pivot for this purpose. Again as is typical, the boat or carrier has mounted thereon a power source 22, which may be of any appropriate type; e.g., internal-combustion engine, electric motor, etc.

The support 16 may be regarded as that part of the boat or carrier that carries the excavator basket 12, and the shaft 14 is journaled in this support at its basket end by a bearing means, here a bronze or equivalent bushing 23. This end of the shaft extends axially beyond the bushing and is coaxially keyed to a hub 24 that is part of the excavator cutterhead or basket. The support, according to the invention is a substantially water-tight casing 26 made up of a plurality of coaxially arranged tubular parts concentrically arranged about the shaft 14, including a collar 28 about the excavator hub, an extension 30 and a tubular bell section 32. The excavator end of the tube extension 30 is rigidly joined, as by welding and a flange 34, to a circular, stationary back plate 36 which backs up the rear of the excavator. The collar 28 stops just axially short of the hub 24, in practice by about $\frac{1}{8}''$ to minimize the amount of sand that might intrude into the seal area. Not shown here is conventional means for flushing this area with water to prevent sand from adhering to the parts of the bearing (to be presently described). The other end of the tube 26-30 is coaxially welded to the smaller part of the bell section at 38, and the large end of the bell is rigidly secured by bolts 40, for example, to means forming part of or driven by the power source 22, as will be described in detail immediately below.

The means just described here comprises a hydraulic driving means such as a motor 42 powered by a conventional pump 44 (FIG. 1) which is in turn driven by the power source or engine 22. Forward and reverse selective drive of the motor is achieved by means of a control valve 46 and hydraulic lines 48. A portion of the motor is broken away to show its crankcase 50, its output shaft 52 and some of the bearings 54. Rigidly secured to the motor in series or end-to-end relation thereto is a torque amplifier or torque hub 56 having a shaft 58 coaxially coupled to the motor shaft 52. The torque hub shaft extends axially into the bell section 32 and is coaxially coupled at 60 to the near end of the drive or propeller shaft 14, thus establishing drive straight through to the excavator. The torque hub may be of any suitable type, that shown here being known as the Fairfield Model S3A of 24 H.P.; although any satisfactory substitute may be used so far as concerns the present invention.

It is a feature of the invention that hydraulic fluid from the crankcase of the motor 42 is used to supply the interior of the tubular casing means or enclosure 26. To accomplish that, resort has been had here to removing the seal (not shown) from the junction between the motor and the torque hub, whereby crankcase fluid may flow into the casing 62 of the torque hub, whence it flows past the torque hub and bearings 64 and into the casing 26. The seals have also been removed from the torque hub in this area. Thus the motor crankcase 50 and torque hub casing 62 form interconnected chambers or passage means leading to the interior of the shaft-enclosing casing 26. At this point, it will be seen that the section 32 is made bell-shaped to accomodate the torque hub and shaft coupling 60. FIG. 5 shows an alternate method of passing fluid from the motor to the torque hub, as by external passage means of conduit 66.

From the description thus far, it is seen that the entire enclosure or casing means 26 is stationary, at least to the extent that it is non-rotatable, and that the composite shaft 14, coupling 60 and torque hub and motor shafts are journaled in this casing by the bronze bushing 23 and torque hub and motor bearings 64 and 54. Because the casing is bolted at 40 to the torque hub and motor assembly and is welded at its other end to the backplate 36 via the flange 34 and collar 28 about the bronze bushing, the casing is substantially water-tight and defines a space about the shaft for containing fluid derived from the hydraulic motor case. Within the collar 28, to the rear (left as seen in FIG. 3) of the back plate 36, that portion of the shaft 14 that is coaxially extended to connect with the cutterhead hub 24, the space is exposed to water under pressure, which varies of course according to the submerged depth of the excavator. A sealing means 68 is located within the collar. A seal found to be especially efficient and practical may be of the type known by the trademark "Duo-Cone", a product of Caterpillar Industrial Products, Inc., Peoria, Illinois 61629. The seal as shown here comprises a pair of symmetrical seal rings 70 and 72, the former welded at 74 to the tube 30 and the latter fixed to the shaft 14 by a set screw 76 (FIG. 4). Thus, the ring 72 rotates relative to the ring 70. Each ring 70, 72 contains a smaller, concentric inner ring 78, each having an annular groove 80 supplemented by an annular groove 82 in its mating outer ring. An O-ring 84 is carried by the grooves in each mating set of rings 70/78 and 72/78. Each inner ring is larger in diameter than the shaft 14, leaving an annular space 85. The facing radial surfaces of the inner rings 78 are lapped to provide a smooth radial face 86 that functions to prevent or at least minimize the passage of fluid inwardly or outwardly. The O-rings operate for the same purpose to provide a substantially sealed interior annular chamber 88 to the rear (left as seen in FIG. 4) of the bronze bushing 23.

The interior of the tubular casing 26 is vented to atmosphere by a line 90 that leads back above water, as to a hydraulic fluid reservoir 92 on the boat, which reservoir serves the hydraulic pump 44.

As is typical in dredges of this general type, sand, gravel and the like extracted from the bed or bottom of the body of water is delivered to the base site (here the boat 10) by a suction tube 94, shown somewhat foreshortened here but understood to be of any selected length by the addition of suitable extensions as is known in the art.

In the use of the apparatus, the base or boat is located at a site suitable for the extraction of sand, gravel, etc., and the excavator 12 is lowered to the selected depth. As will be clear, water under pressure, depending upon the depth, exists and tends to force its way into the collar 28 and past the seal means 68. However, the interior of the casing 16 is full, or substantially full, of hydraulic fluid that finds its way from the hydraulic motor, and the interior of the casing, being vented at 90, is pressurized by the head or static column of fluid existing in the line 90. The tendency of the water to get past the seal is countered by the hydraulic fluid on the other side of the bronze bushing 23. The internal resistance to entry of water is further enhanced by the hydraulic fluid that has found its way through the bronze bushing into the chamber 80 within the seal means 68. Satisfactory results have been obtained with the open end of the vent line 90 (leading to the reservoir 92) about four to five feet above water level. The oil or hydraulic fluid pressure is initially greater than the water pressure at depths of the excavator of about twenty-five feet below water. At greater depths, the pressure is on the side of the water, mainly because of the difference in specific gravity of water (1) and oil (0.9). To facilitate use and operation, a sight glass 94' may be provided in the vent line 90. The sight glass provides an important indication of seal function. The passage of water into the casing will be indicated by water in the sight glass. The oil return port 90 is on the lower end of the casing when in operation. The water (heavier than oil) settles in this area and is forced to the sight glass where it settles for operator observation. The operator thus warned can repair or replace the seal before water or sand intrudes to an extent to cause damage to the bushing or other drive components.

The present invention enables the use of a much less costly seal and bearing in the area subject to water pressure. The substantial balancing of oil and water pressure across the seal virtually eliminates contamination and premature wear of parts from the fines and other water-borne particles small enough to find their way into prior art constructions.

I claim:

1. Dredging apparatus of the class described having an above-water carrier, an under-water excavator, a substantially water-tight tubular casing means having an upper portion relatively proximate to the carrier and an under-water lower portion proximate to the excavator, a drive shaft extending axially through the casing and having a lower end projecting beyond the lower end of the casing and connected to the excavator and an upper end proximate to the upper portion of the casing, and bearing means within the casing adjacent to its lower portion and journalling the shaft, said bearing means having axially opposite first and second ends, the first of which faces toward water at the lower portion of the casing and the second of which lies within and is contained by the casing, characterized in that a hydraulic power source is secured to the upper portion of the casing and is coaxially connected to the upper end of the shaft, said power source having a chamber adapted to contain oil for driving said source, passage means communicating with the chamber and the interior of the casing for conducting oil lengthwise of the casing to the casing-contained second end of the bearing means, and vent means connected to the lower portion of the casing in the area of the casing-contained end of the bearing means and extending to an open upper end above water for containing a head of oil substantially equal to the water pressure exerted on the first end of the bearing means.

2. The invention defined in claim 1, further characterized in that a torque amplifier is drivingly interposed between the power source and the upper end of the shaft, said torque amplifier having oil-conducting means serially connected in the passage means for conducting oil from the chamber through the torque amplifier to the casing.

3. The invention defined in claim 1, further characterized in that a plate-like member is disposed radial to and rigidly secured to the casing axially upwardly of the casing lower portion so that said lower portion and the first end of the bearing means project axially beyond the member toward the excavator, a collar is rigidly secured to the member and concentrically surrounds said lower portion and first end of the bearing means as well as the lower end of the shaft that projects beyond the casing lower portion, and annular seal means encircles the projecting shaft portion within the collar in sealing relation to the exposed end of the bearing means.

4. The invention defined in claim 3, further characterized in that the seal means includes a pair of closely spaced rings, one of which is secured to the projecting shaft portion and the other of which is secured to the casing lower portion.

* * * * *